US007954841B2

(12) United States Patent
Guex et al.

(10) Patent No.: US 7,954,841 B2
(45) Date of Patent: Jun. 7, 2011

(54) GLIDING BOARD WITH RIGIDIFYING INSERT AND METHOD OF MANUFACTURE

(75) Inventors: Jean-Philippe Guex, Cran Gevrier (FR); Patrick Metral, Annecy le Vieux (FR); Aldric Bourgier, Vieugy (FR); Lionel Favret, Annecy (FR)

(73) Assignee: Salomon S.A.S, Metz-Tessy (FR)

( * ) Notice: Subject to any disclaimer, the term of this patent is extended or adjusted under 35 U.S.C. 154(b) by 176 days.

(21) Appl. No.: 12/015,118

(22) Filed: Jan. 16, 2008

(65) Prior Publication Data

US 2008/0179872 A1 Jul. 31, 2008

(30) Foreign Application Priority Data

Jan. 17, 2007 (FR) ..... 07 00306

(51) Int. Cl.
*A63C 5/07* (2006.01)

(52) U.S. Cl. ..... 280/602; 280/609

(58) Field of Classification Search ..... 280/601, 280/602, 608–610, 11.16, 845
See application file for complete search history.

(56) References Cited

U.S. PATENT DOCUMENTS

| | | | | |
|---|---|---|---|---|
| 2,851,277 | A * | 9/1958 | Holmberg et al. | 280/610 |
| 3,652,102 | A * | 3/1972 | Eaton | 280/610 |
| 3,771,805 | A * | 11/1973 | Ishida | 280/610 |
| 4,026,575 | A * | 5/1977 | Hartwig | 280/610 |
| 5,143,394 | A * | 9/1992 | Piana | 280/602 |
| 5,435,589 | A * | 7/1995 | Fagot | 280/610 |
| 5,544,908 | A * | 8/1996 | Fezio | 280/610 |
| 6,082,747 | A * | 7/2000 | Parmentier | 280/14.22 |
| 6,488,308 | B1 * | 12/2002 | Clausing | 280/602 |
| 6,945,563 | B2 * | 9/2005 | Clausing | 280/809 |

FOREIGN PATENT DOCUMENTS

| | | |
|---|---|---|
| DE | 27 04 858 A1 | 8/1978 |
| DE | 100 19 655 A1 | 10/2001 |
| EP | 1 297 869 A1 | 4/2003 |
| FR | 1 450 993 A | 6/1966 |
| FR | 2 794 374 A1 | 12/2000 |
| FR | 2 848 465 A1 | 6/2004 |

* cited by examiner

*Primary Examiner* — J. Allen Shriver, II
*Assistant Examiner* — Erez Gurari
(74) *Attorney, Agent, or Firm* — Greenblum & Bernstein, P.L.C.

(57) ABSTRACT

Gliding board that includes an upper sub-assembly, a lower sub-assembly, and an intermediate core, the upper sub-assembly including a first longitudinal opening, the lower sub-assembly including a second longitudinal opening, and the intermediate core including a third longitudinal opening, each of the first, second, and third longitudinal openings being positioned at the rear end of the gliding board, the gliding board further including a rigidifying element that is inserted simultaneously in the first, second, and third longitudinal openings. The rigidifying element can have a planar, bulging, or convex lower surface.

51 Claims, 6 Drawing Sheets

2
4
5
7
6
13
14
3

8
21
V
V
20
19
2
3

17
13
14
8
21
9
2
3

GLIDING BOARD WITH RIGIDIFYING INSERT AND METHOD OF MANUFACTURE

CROSS-REFERENCE TO RELATED APPLICATION

This application claims priority under 35 U.S.C. §119 of French Patent Application No. 07 00306, filed on Jan. 17, 2007, the disclosure of which is hereby incorporated by reference thereto in its entirety.

BACKGROUND OF THE INVENTION

1. Field of the Invention

The invention relates to a gliding board, such as a ski, that is adapted for winter sports. More particularly, the invention relates to a gliding board intended for relatively new snow gliding activities and sports, such as freestyle or freeride skiing.

2. Description of Background and Other Information

Freestyle Involves performing acrobatic figures and jumps.

Freeride is a free and varied activity practiced on the mountain. The user descends the slopes on-piste or off-piste, i.e., on groomed or ungroomed surfaces, in any type of snow, including powder snow, for example. Swallow tail skis are known for skiing In powder snow. An example of this type of ski is disclosed in DE 27 04 868. A ski of this type is particularly adapted for use in powder or freshly fallen snow. In addition to providing certain flexibility, the swallow tail ski also reduces torsional strain on the ski while maintaining the ski in a flat position In this regard, the two rear end portions of the ski, because of their possibility of movement with respect to one another, can more easily remain flat on the snow. This ability of the rear end portions of the ski to remain flat provides the skier with a sense of sliding, that is, a better sense of side slip, associated with skis of this type. However, these skis have a number of limitations because they are very flexible. Thus the bending strain in the rear zone is very substantial and, therefore, these types of skis are not recommended by those skilled in the art for use in freestyle skiing, or even for use in freeride skiing. These skis do not provide the user with adequate support when landing a jump or performing other tricks and maneuvers.

SUMMARY OF THE INVENTION

The present invention improves the performance of swallow tail skis, thereby increasing their versatility among a variety of types of skiing.

The invention provides a ski that is rigid for the practice of freeride and freestyle skiing, particularly providing for their use in executing jump landings in particular.

Further, the invention provides a ski that is torsionally tolerant in its rear portion.

Still further, the invention provides a ski that improves the sense of gliding, and especially improves the sense of sliding at the end of a turn.

Further yet, the invention provides a gliding board that allows modularity for the manufacturer, retailer, and user.

Additionally, the invention provides a gliding board having a non-planar gliding sole, which can be convex or concave.

The invention provides a method of manufacturing a ski having the aforementioned characteristics. In particular, the invention provides a method of machining a ski that does not have flat gliding surfaces.

More particularly, the invention provides a gliding board for practicing winter sports, which includes a gliding board blank having an elongated cutout or opening, provided in its rear end, as well as a rigidifying insert inserted into the elongated cutout and fixed to the gliding board blank, such that there is no relative movement between the rigidifying insert and the gliding board.

Also, the invention provides a gliding board including an upper subassembly, a lower sub-assembly, and an intermediate core, the upper sub-assembly including a first longitudinal opening, the lower subassembly including a second longitudinal opening, and the intermediate Core including a third longitudinal opening, each of the first, second, and third longitudinal openings being located in the rear end of the gliding board, the gliding board further including a rigidifying element, i.e., a stiffening element, that is inserted simultaneously in both the second and third longitudinal openings.

In a particular embodiment, the rigidifying element is inserted simultaneously in the first and second openings, as well as in the third opening.

Advantageously, the rigidifying element can assume any of a plurality of shapes. In particular, it has a lower surface that can be planar, bulging or convex.

In a particular embodiment, the rigidifying element includes a front portion that is inserted in the first, second, and third openings, and a rear portion that is outside of these openings and thereby constitutes the rear end of the gliding board.

To enable the rigidifying element to be embedded, the first longitudinal opening is substantially narrower than the second and third longitudinal openings.

In a particular embodiment of the invention, the rigidifying element can be removed after the gliding board has been manufactured.

The invention also includes a method of manufacturing a gliding board, which involves making a gliding board blank including an elongated cutout or cutout at its rear end, inserting a rigidifying insert inside the elongated cutout, and then fixing the rigidifying insert to the gliding board blank, such that no relative movement is possible between the rigidifying insert and the gliding board blank.

In a particular embodiment, the method of manufacturing a gliding board according to the Invention includes the following:

- preparing an upper sub-assembly including a top layer;
- preparing a lower sub-assembly including a gliding sole and running edges, the lower sub-assembly including a second longitudinal opening,
- preparing a core having a third longitudinal opening;
- preparing a finishing spacer;
- preparing a rigidifying element;
- positioning the upper sub-assembly, lower subassembly' and core in a mold, so as to obtain a gliding board blank;
- first finishing phase;
- positioning the finishing spacer in the opening for the machining in a longitudinal opening provided in the rear portion of the blank;
- second finishing phase;
- positioning the rigidifying element in the second and third longitudinal openings:
- fixing the rigidifying element to the gilding board.

For the case in which the gliding board blank is made using an injection molding technique, the method of making a gliding board according to the invention includes the following:

- preparing an upper sub-assembly including a top layer, the upper sub-assembly optionally including a first longitudinal opening;

preparing a lower sub-assembly including a gliding sole and running edges, the lower sub-assembly including a second longitudinal opening;

preparing a rigidifying element;

positioning the upper sub-assembly and lower sub-assembly in a mold;

injecting the material adapted to constitute the core so as to obtain a gliding board blank;

positioning the rigidifying element in the first, second, and third longitudinal openings;

fixing the rigidifying element to the gliding board.

For the case in which the rigidifying insert has a flat, or planar, lower surface, the method of making a gliding board according to the invention includes the following:

preparing an upper sub-assembly including a top layer;

preparing a lower sub-assembly including a gliding sole and running edges, the lower sub-assembly including a second longitudinal opening;

preparing a core having a third longitudinal opening;

preparing a rigidifying element, positioning the upper sub-assembly, lower sub-assembly, and core in a mold so as to obtain a gliding board blank;

first finishing phase;

positioning the rigidifying element in the second and third longitudinal openings;

fixing the rigidifying element to the gliding board;

second finishing phase.

BRIEF DESCRIPTION OF DRAWINGS

The invention will be better understood from the description that follows, with reference to the attached drawings, in which.

DETAILED DESCRIPTION OF THE INVENTION

Figure 1:
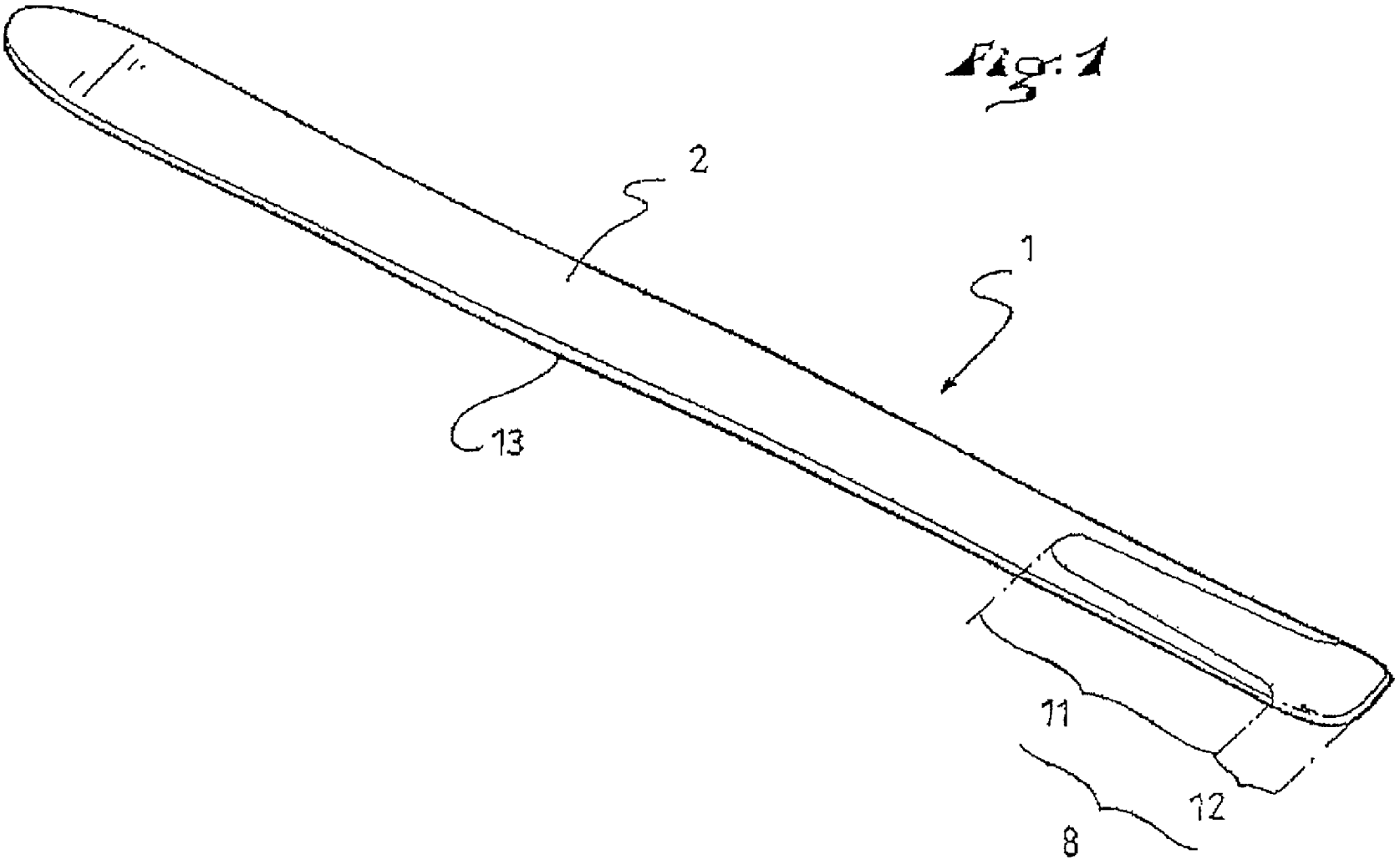
FIG. 1 is a perspective view of a gliding board according to a first embodiment of the Invention.

FIG. 1 shows a perspective view of a gliding board 1 according to a first embodiment of the invention. The gliding board includes a gliding board blank 16 (see FIG. 3) and, a stiffening, or rigidifying, Insert 8. It will be seen hereinafter that the gliding board blank 15 is made in the form of a finished ski, and that it is only at or near the end of the gliding board manufacturing process that the rigidifying insert 8 is inserted.

Figure 3:
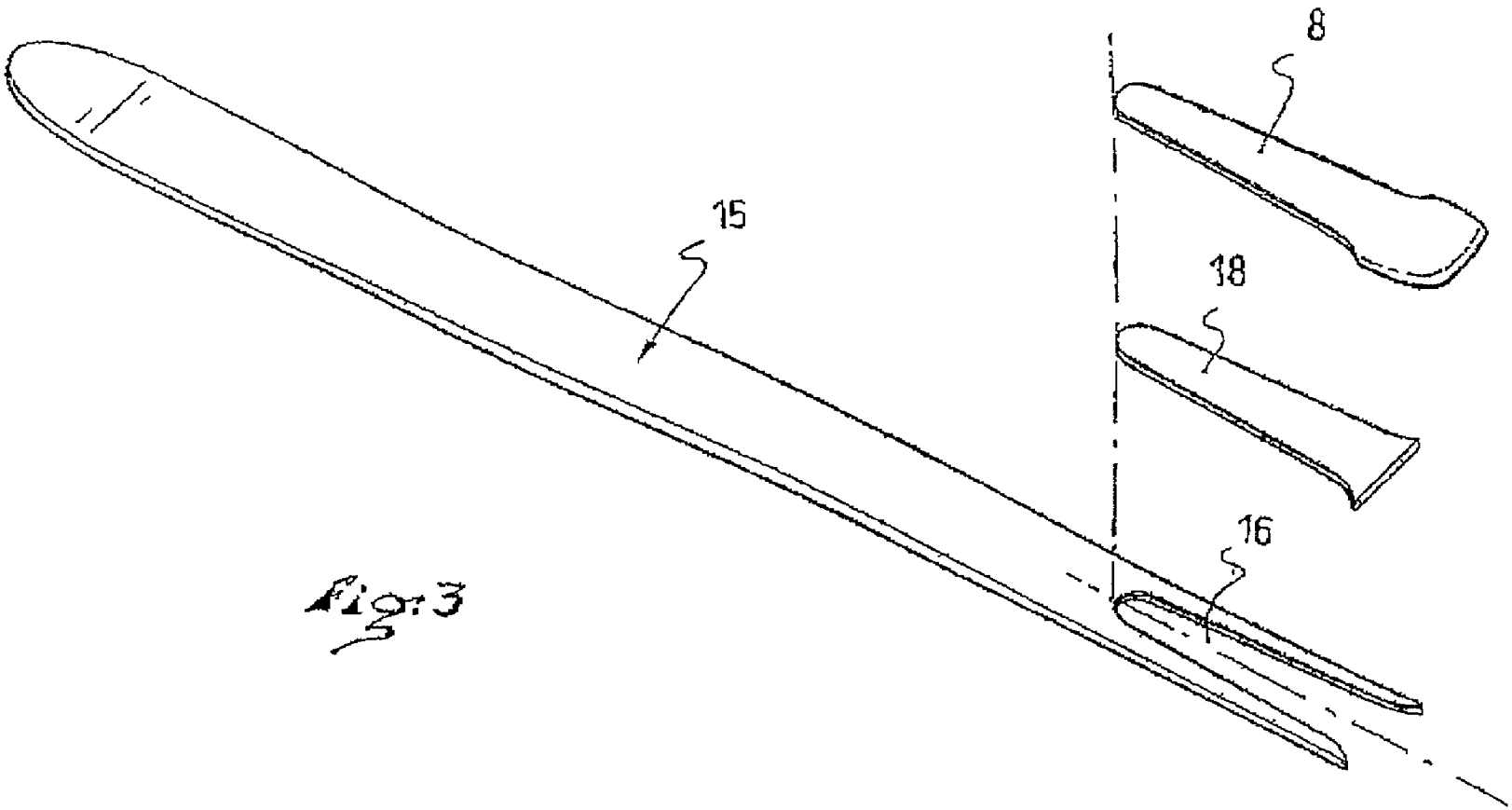
FIG. 3 is a perspective view of a gliding board blank consistent with the gliding board illustrated in FIG. 1.

The rear end of the gliding board blank 15 includes an elongated cutout 16 (see FIG. 3). Thus, the contour of the end of the gliding board blank 15 is that of a so-called swallow tail gliding board. More particulary, as can be seen in FIG. 3, the contour includes an elongated cutout 16 having a progressively increasing width along a rearward direction. The rigidifying insert 8 is inserted in the elongated cutout 16 provided In the rear end of the gliding board blank 15, as shown in FIGS. 1 and 3, the cutout extending through the thickness of the blank. The insert 8 has a thickness that extends at least from an upper surface of the blank to a lower surface of the blank.

The rigidifying insert includes two portions, viz., a front portion 11 and a rear portion 12. The front portion 11 is integrally inserted and is fitted within the elongated cutout 16 of the gliding board blank 15. The rear portion 12 of the rigidifying insert 8 projects rearwardly from the elongated cutout and thus constitutes the rear end of the gliding board 1 once the manufacture of the gliding board is completed.

The manufacture of a gliding board according to the invention involves making a gliding board blank including an elongated cutout, and then inserting a rigidifying insert within the elongated cutout. The gliding-board blank can be made in the manner known in the prior art for manufacturing a gliding board that is, using any of various known manufacturing methods. Currently, two commonly used methods include the gluing technique, whereby all of the components of the gliding board are positioned in a mold, whereby the assembled components are subject to pressure and heat, or the Injection technique, whereby all of the components, exclusive of the core, are positioned in a mold, which is then closed, and Inside of which a foam is injected which, when hardened, comprises the core. There are other hybrid methods derived from these two methods, which could be used for the current invention, in which part of the core is prepared prior to being positioned in the mold, whereas the remainder of the core is made by injection molding.

Figure 2:
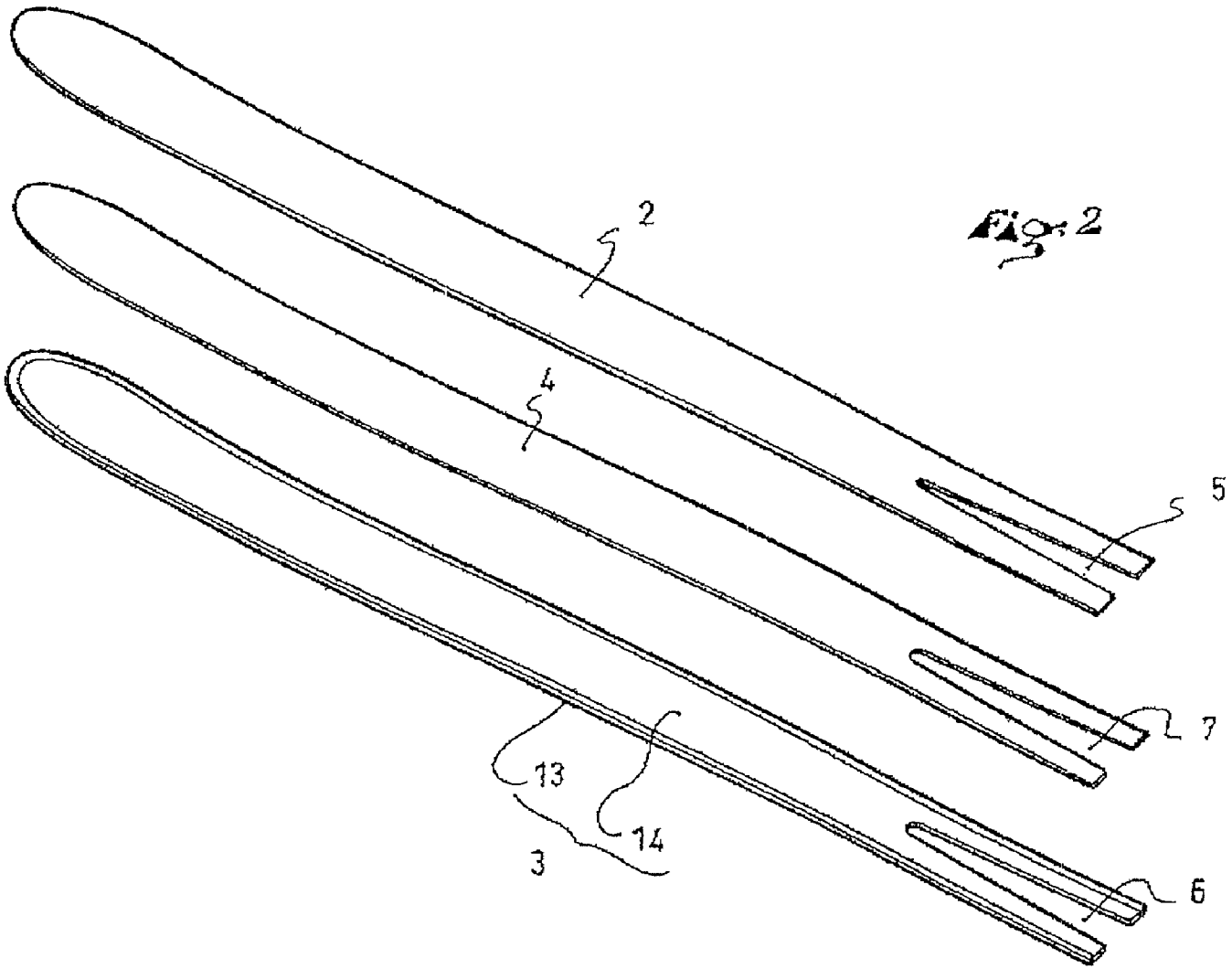
FIG. 2 is an exploded perspective view of various components of the gliding board illustrated in FIG. 1.

FIGS. 2 and 3 are illustrative of a method of manufacturing a gliding board according to the invention.

A method of manufacturing a gliding board according to the invention includes the following aspects.

First, there are various steps of preparing various components of a gliding board according to the invention. Such steps include preparing an upper sub-assembly 2, preparing a lower sub-assembly 3, preparing an Intermediate core 4, preparing a finishing spacer 18, and preparing a rigidifying insert 8.

The following description will not provide in detail all of the aspects of the preparation, particularly because certain such steps are commonly known in the prior art, as mentioned above.

Such known aspects of the preparation, although not described in detail herein, include preparing an upper sub-assembly, preparing the lower sub-assembly, and preparing the intermediate core.

The upper sub-assembly 2 includes at least one top layer that protects the gliding board and its decoration. The upper subassembly optionally contains one or more reinforcement layers. The upper sub-assembly can also contain other elements, such as an interface, enabling the binding elements to be attached to the ski, in the case in which the binding elements are attached to the gliding board during the manufacture of the board.

In a known manner, the lower subassembly 3 includes running edges 13, which can be made of metal, as well as a gliding sole 14 and a reinforcement, or reinforcement layer, 17.

The finishing spacer 18 and the rigidifying insert 8 are described in more detail below.

The manufacture of the gliding board blank 15 follow the various phases of preparing the components of the gliding board.

These phases begin with the positioning of the upper sub-assembly 2, lower sub-assembly 3, and core 4 in a mold. The mold is heated and then positioned in a press to produce a gliding board blank.

As shown in FIG. 2, a first longitudinal opening 5 is provided at the rear end of the upper subassembly 2. A second longitudinal opening 6 is provided at the rear end of the lower sub-assembly. A third opening 7 is also provided at the rear end of the intermediate core.

The first, second, and third openings have the same dimensions, or substantially the same dimensions. Furthermore, they become superimposed and vertically aligned when the upper sub-assembly, lower sub-assembly, and core are themselves superimposed.

After the mold is positioned in the press and heated, a gliding board blank 15, such as that seen in FIG. 3, is produced.

The following description is that of a first finishing phase.

The first finishing phase includes the lateral trimming of the gliding board blank. Lateral trimming is a common operation in the manufacture of gliding boards, and involves clipping, or otherwise removing, the unnecessary portion of the upper sub-assembly that overlaps the running edges when the gliding board blank is removed from the mold.

in an alternative embodiment, the upper sub-assembly 2, prior to the first opening being provided therein, is positioned in the mold. It is during the first finish operation that the first opening 5 is cut out from the upper sub-assembly Using any cutting tool and technique suitable for the purpose, such as a saw, a punch, etc.

The gliding board blank 15 includes an elongated cutout 16 in its rear portion, this elongated cutout being made by superimposing the first opening 5, third opening 7, and second opening 6.

The elongated cutout 16 has a V-shaped contour, or a generally V-shaped contour with a rounded front end, as shown, the V-shaped contour being provided to enable the finishing spacer and the rigidifying insert to be inserted more easily.

Next, a finishing spacer 18 is positioned in the elongated cutout 16. The finishing spacer 18 is a rigid element whose shape very closely complements that of the elongated cutout 16. Its lower surface is flush with the surface of the gliding sole, even slightly set back with respect to the lower surface of the gliding sole.

Following the positioning of the finishing spacer 18 in the elongated cutout 16 is a second finishing phase. The gliding sole and the running edges are machined during this second finishing phase. Such machining can include sanding, grinding, or otherwise refinishing the sole and running edges to bring such snow- or terrain-engaging surfaces to pre-use condition.

The finishing spacer 18 is removed once the machining operation is completed. The gliding board blank 15 is now completed.

Finally, the rigidifying insert 8 is inserted in the elongated cutout, and then the rigidifying insert 8 is fixed to the gliding board blank 15.

The preceding method of manufacturing a gliding board relates to one in which the intermediate core 4 is prepared prior to being positioned in the mold. However, the manufacturing method according to the invention may well also apply to the case in which the intermediate core is made In the mold, rather than being positioned therein. This is particularly the case for gliding boards made by injection molding.

To make a gliding board by injection molding, one inserts a lower sub-assembly and an upper subassembly in a mold. The mold is closed and the material that constitutes the intermediate core is injected. Therefore, in an alternative manufacturing method according to the invention, the aspect by which the intermediate core is prepared is replaced by a step of injecting the core material into the mold.

Figure 4:
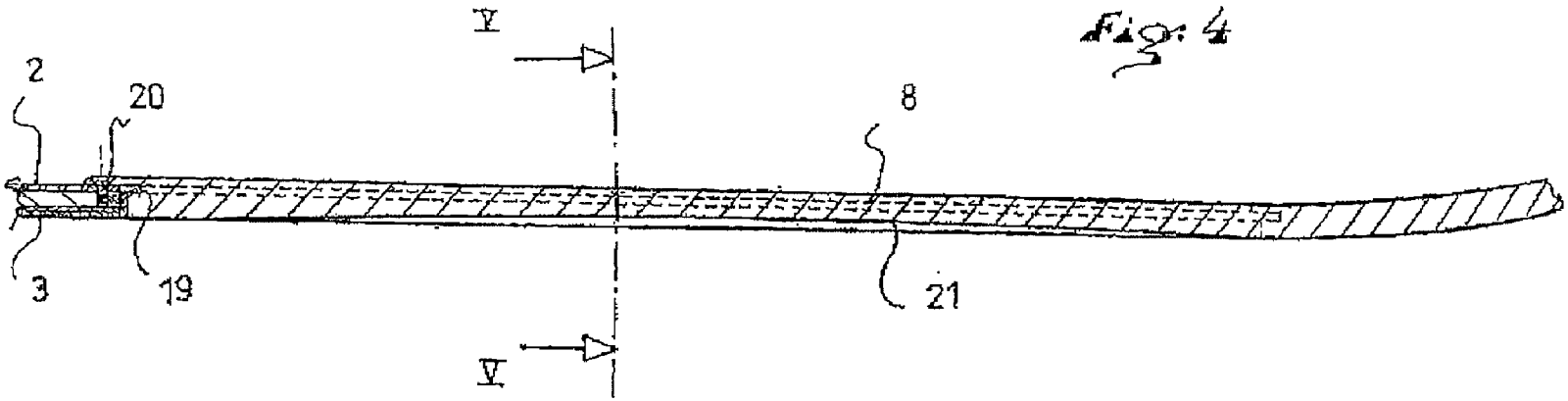
FIG. 4 is a partial longitudinal crossectional view of the rear portion of the gliding board illustrated in FIG. 1.
Figure 5:
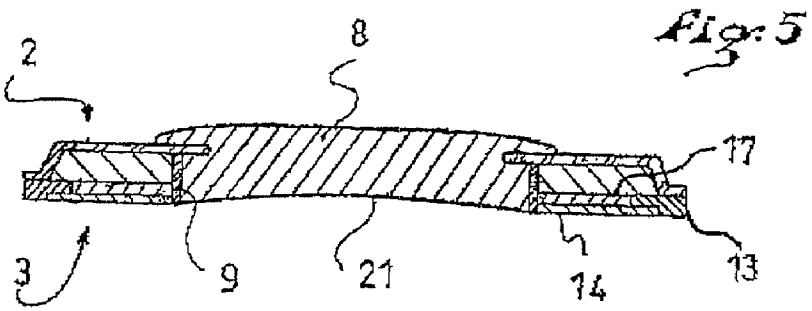
FIG. 5 is a transverse cross-sectional view along the rear portion of the gliding board illustrated in FIG. 1.

As shown in FIGS. 4 and 5, the rigidifying insert 8 is embedded in the gliding board blank 15. The embedding is guaranteed because the first opening 5, provided in the upper sub-assembly 2, is slightly smaller than the second 6 and third 7 openings provided in the lower sub-assembly 3 and in the Intermediate core 4, respectively. A peripheral groove 19 is provided on the periphery of the rigidifying insert 8. The groove 19 is dimensioned such that the upper subassembly can be inserted therein. At the front of the rigidifying insert 8, a screw 20 retains the latter on the gliding board blank.

Fixing the rigidifying insert with one or more screws 20 enables the user to remove the rigidifying insert, and to replace it with another rigidifying insert. Thus, one wan provide various rigidifying inserts for various uses. One can also provide rigidifying inserts with various shapes for various activities. Finally, one can provide rigidifying inserts made of various materials so as to provide the gliding board with various behaviors in bending, i.e., such as in longitudinal flexion, and in torsion, etc.

The rigidifying insert shown in FIGS. 4 and 5 includes a concave lower surface 21, which makes it possible to improve the lift of the rear end of the gliding board. An improved lift is useful in powder snow, but also on packed snow, for example in freestyle, when landing a jump.

The concave lower surface of the rigidifying insert 8 is flush with the lower surface of the gliding sole 14.

In an alternative embodiment of the Invention, the rigidifying insert 8 is fixed to the gliding board blank by a non-removable arrangement or means. Thus, the user is not allowed to modify the ski by changing the rigidifying insert. However, this provides modularity for the manufacturer of gliding boards. Indeed, the manufacturer can make Various skis using the same gliding board blank as a basis.

In another alternative embodiment of the invention, the rigidifying insert is fixed to the gliding board blank by an arrangement or means that is difficult to remove. An arrangement or means difficult to remove is not intended to be removed by the end user. However, such arrangement or means can be removed by a professional, such as a retailer or a gliding board repair technician, for example. The aim of such Alternative embodiment is to enable professionals to remove the rigidifying insert in order to have the running edges or the gliding sole machined, i.e., reconditioned after use and wear.

For a the gliding board such as illustrated in FIGS. 1 to 5, the upper sub-assembly and the lower sub-assembly each include a fiber reinforcement that is resin-impregnated prior to insertion in the mold. At the time the mold is positioned in the press and heated the resin Cures and hardens. The excess of resin flows out and forms a vertical skin 9 on the periphery of the elongated cutout. This skin 9 makes the gliding board waterproof in the area of the cutout.

Figure 6:
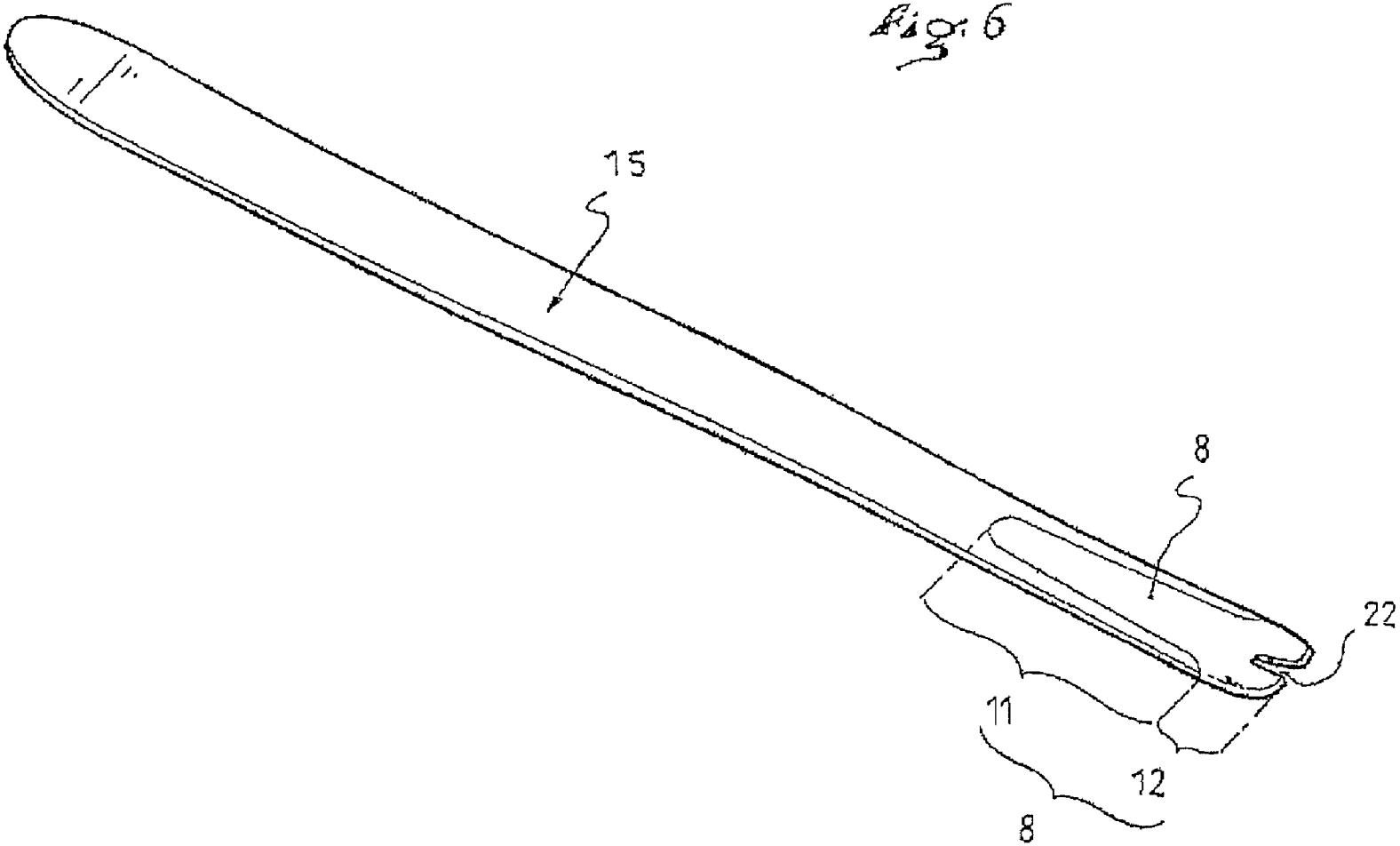
FIG. 6 is a perspective view of a gliding board according to a second embodiment of the invention.

FIG. 6 shows a perspective view of a second embodiment of the invention.

As in the preceding embodiment, the gliding board shown in FIG. 6 includes a gliding board blank 15 and a rigidifying Insert 8. The rigidifying insert 8 includes a front portion 11 inserted in an elongated cutout in the gliding board blank, and a rear portion 12 that projects rearwardly from the gliding board blank and forms the rear end of the gliding board. An opening in the form of a slit 22, or a slot is provided in the rear portion 12 of the rigidifying insert 8. This slit serves to lighten the gliding board and to evoke the swallow tail shape of the gliding board blank, This slit also enables sealskin to be attached for cross-country skiing.

Figure 7:
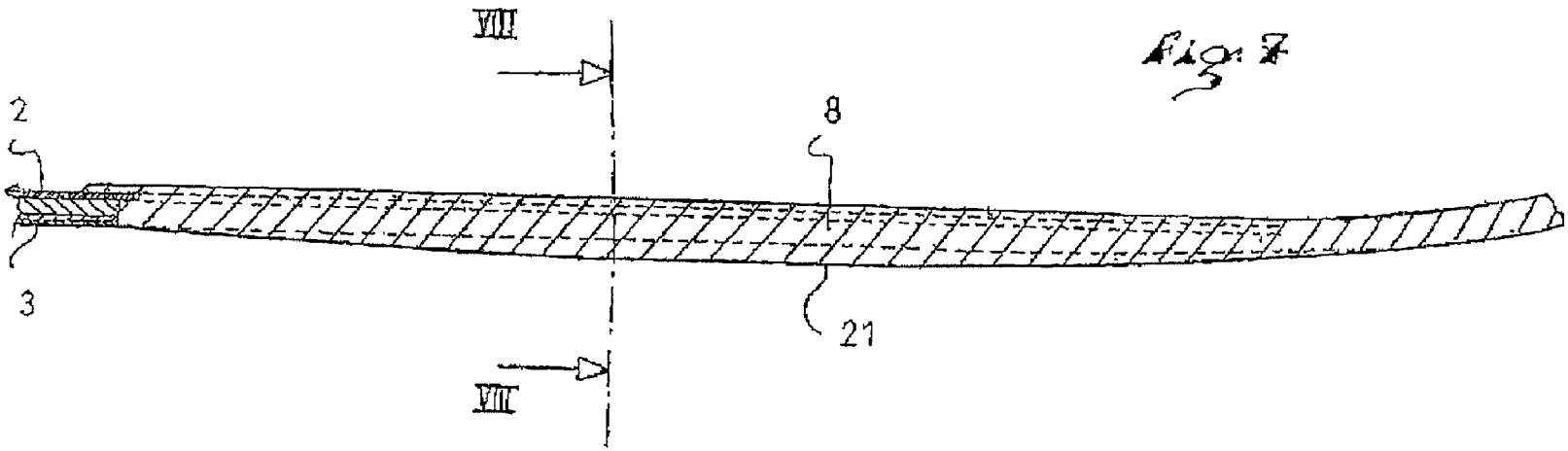
FIG. 7 is partial longitudinal cross-sectional view of the rear portion of the gliding board illustrated in FIG. 6.
Figure 8:
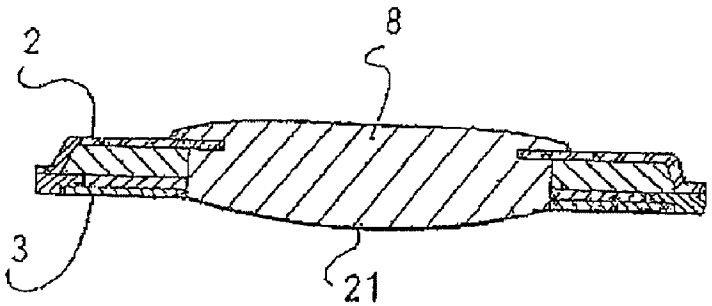
FIG. 8 is a transverse cross-sectional view of the gliding board illustrated in FIG. 6, taken along lines VIII-VIII in FIG. 7.

FIGS. 7 and 8 show a longitudinal partial cross-sectional view of the gliding board shown in FIG. 6 and a transverse cross-sectional view of the gliding board, respectively. The rigidifying insert 8 differs from the insert described in the first embodiment in that its lower surface is bulges downwardly.

When used in powder snow, a gliding board equipped with a rigidifying insert having a bulging, or convex, lower surface enables the user to have greater control. The bulging portion of the Insert acts as a drift at the rear end of the gliding board. When used on-piste, i.e., such as on well-packed groomed trails, such a gliding board enables the user to have better control of the slide, that is, control during side slip.

Figure 9:
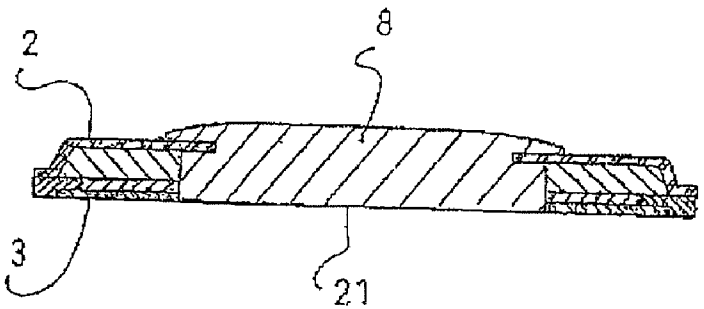
FIG. 9 is a transverse cross-sectional view of a gliding board equipped with a rigidifying insert according to a third embodiment of the invention.

FIG. 9 shows a cross-sectional view of the gliding board 1 equipped with a rigidifying insert 8 according to a third embodiment of the Invention. This insert is partially similar to the inserts described above and, therefore, a more detailed description has not been provided here. It should be noted, however, that the rigidifying insert 8 of FIG. 9 has a flat, or planar, lower surface. Furthermore, when the rigidifying insert 8 is inserted into the elongated cutout of the blank of the gliding board 1, the lower surface of the Insert is in the same plane as the lower surface of the gliding sole. Therefore, It is no longer necessary to have the rigidifying Insert removed from the cutout during machining of the gliding surface of the gliding board after use and wear thereof.

Furthermore, manufacturing a gliding board according to the third embodiment of the Invention proves to be simpler, as it is not necessary to provide a finishing spacer prior to the final assembly of the rigidifying insert.

A method of manufacturing a gliding board 1 according to the third embodiment of the invention includes the following:

preparing an upper sub-assembly 2 including a top layer;

preparing a lower subassembly 3 including a gliding sole 14 and running edges 13, the lower sub-assembly 3 including a second longitudinal opening 6;

preparing a core 4 having a third longitudinal opening 7;

preparing a rigidifying element 8;

positioning the upper sub-assembly 2, lower subassembly 3, and core 4 in a mold so as to obtain a gliding board blank 15;

first finishing phase;

positioning the rigidifying element 8 in the second 6 and third 7 longitudinal openings, fixing the rigidifying element 8 to the gliding board 1;

second finishing phase.

For the case in which the upper sub-assembly is not Gut out prior to being positioned in the mold, the first finishing phase includes cutting a first longitudinal opening 5 in the upper sub-assembly 2. For the other case, it is the step of preparing the upper sub-assembly 2 that includes cuffing out a first longitudinal opening 5.

For the case in which the lower surface of the rigidifying insert is flat or planar, the second finishing phase, which includes machining the gliding sole 14 and the running edges 13, can be carried out after insertion of the rigidifying insert.

As for the other embodiments of the invention, the gliding board according to the Invention may well be made using the injection molding technique. In such a case, the manufacturing method includes the following:

preparing an upper subassembly 2 including a top layer, the upper sub-assembly possibly including a first longitudinal opening;

preparing a lower sub-assembly 3 including a gliding sole 14 and running edges 13, the lower sub-assembly 3 including a second longitudinal opening 6;

preparing a rigidifying element 8;

positioning the upper sub-assembly 2 and lower sub-assembly 3 in a mold;

injecting the material adapted to constitute the core 4 so as to obtain a gliding board blank 15;

positioning the rigidifying element 8 in the first 5, second 6, and third 7 longitudinal openings;

fixing the rigidifying element 8 to the gliding board 1.

The invention is not limited to the particular several embodiments described herein by way of examples, and relates to any and all equivalent embodiments.

LIST OF ELEMENTS

1—Gliding board
2—Upper sub-assembly
3—Lower subassembly
4—Intermediate core
5—First longitudinal opening
6—Second longitudinal opening
7—Third longitudinal opening
8—Rigidifying insert
9—Skin
11—Front portion
12—Rear portion
13—Running edges
14—Gliding sole
15—Gliding board blank
16—Elongated cutout
17—Reinforcement
18—Finishing spacer
19—Groove
20—Screw
21—Lower surface
22—Slit

The invention claimed is:

1. A gliding board comprising:

an upper sub-assembly;

a lower sub-assembly;

an intermediate core;

said upper sub-assembly including a first longitudinal opening;

said lower sub-assembly including a second longitudinal opening;

and said intermediate core including a third longitudinal opening;

each of said first, second, and third longitudinal openings being positioned at a rear end of said gliding board;

each of said first, second, and third longitudinal openings having a width progressively increasing in a rearward direction;

a rigidifying element positioned simultaneously in both of said second and third longitudinal openings.

2. A gliding board according to claim 1, wherein:

said rigidifying element is positioned simultaneously in all of said first, second, and third openings.

3. A gliding board according to claim 1, wherein:

said rigidifying element has a planar lower surface.

4. A gliding board according to claim 1, wherein:

said rigidifying element has a bulging lower surface.

5. A gliding board according to claim 1, wherein:

said rigidifying element has a convex lower surface.

6. A gliding board according to claim 1, wherein:
said rigidifying element includes a front portion positioned within at least said first and second openings, and a rear portion extending rearwardly beyond said first and second openings, said rear portion of said rigidifying element thereby constituting the rear end of said gliding board.

7. A gliding board according to claim 1, wherein:
said first longitudinal opening is substantially narrower than each of said second and third longitudinal openings.

8. A gliding board according to claim 1, wherein:
said rigidifying element is removable and re-insertable after said gliding board has been manufactured.

9. A method of manufacturing a gliding board comprising:
making a gliding board blank having a rear end with an elongated cutout;
said elongated cutout having a width progressively increasing in a rearward direction;
inserting a rigidifying insert within said elongated cutout, said insert extending at least from an upper surface of the blank to a lower surface of the blank; and
fixing said rigidifying insert to said gliding board blank, such that no relative movement is possible between said rigidifying insert and said gliding board blank.

10. A method of manufacturing a gliding board according to claim 9, said method comprising the following:
preparing an upper sub-assembly including a top layer having a first longitudinal opening;
preparing a lower sub-assembly including a gliding sole and running edges, said lower sub-assembly comprising a second longitudinal opening;
preparing a core having a third longitudinal opening;
preparing a finishing spacer;
preparing a rigidifying element;
positioning said upper sub-assembly, lower sub-assembly, and core in a mold, so as to obtain a gliding board blank;
performing a first finishing phase;
positioning said finishing spacer in said first and second longitudinal openings for machining in said elongated cutout in said rear end of said blank;
performing a second finishing phase;
positioning the rigidifying element in said second and third longitudinal openings;
fixing said rigidifying element to the gliding board.

11. A method of manufacturing a gliding board according to claim 10, wherein:
said preparing an upper sub-assembly includes cutting out a first longitudinal opening.

12. A method of manufacturing a gliding board according to claim 10, wherein:
said first finishing phase includes cutting out a first longitudinal opening in said upper sub-assembly.

13. A method of manufacturing a gliding board according to claim 10, wherein:
said first finishing phase includes lateral trimming of the gliding board.

14. A method of manufacturing a gliding board according to claim 10, wherein:
said second finishing phase includes machining of said gliding sole and said running edges.

15. A method of manufacturing a gliding board according to claim 9, comprising the following:
preparing an upper sub-assembly including a top layer;
preparing a lower sub-assembly including a gliding sole and running edges, said lower sub-assembly comprising a second longitudinal opening;
preparing a core having a third longitudinal opening;
preparing a rigidifying element;
positioning said upper sub-assembly, said lower sub-assembly, and said core in a mold so as to obtain a gliding board blank;
performing a first finishing phase;
positioning the rigidifying element in said second and third longitudinal openings;
fixing said rigidifying element to the gliding board;
performing a second finishing phase.

16. A method of manufacturing a gliding board according to claim 15, wherein:
said preparing an upper sub-assembly includes cutting out said first longitudinal opening.

17. A method of manufacturing a gliding board according to claim 15, wherein:
said first finishing phase includes cutting out said first longitudinal opening in said upper sub-assembly.

18. A method of manufacturing a gliding board according to claim 15, wherein:
said first finishing phase includes lateral trimming of the gliding board.

19. A method of manufacturing a gliding board according to claim 15, wherein:
said second finishing phase includes machining said gliding sole and said running edges.

20. A method of manufacturing a gliding board according to claim 9, comprising:
preparing an upper sub-assembly including a top layer;
preparing a lower sub-assembly including a gliding sole and running edges, said lower sub-assembly comprising a second longitudinal opening;
preparing a rigidifying element;
positioning said upper sub-assembly and lower sub-assembly in a mold;
injecting material adapted to constitute a core of the gliding board so as to obtain a gliding board blank;
positioning the rigidifying element in said first, second, and third longitudinal openings;
fixing said rigidifying element to the gliding board blank.

21. A method of manufacturing a gliding board according to claim 20, wherein:
said upper sub-assembly includes a first longitudinal opening.

22. A gliding board for practicing winter sports, said gliding board comprising:
a gliding board blank having a rear end with a rearwardly opened elongated cutout;
said elongated cutout having a width progressively increasing in a rearward direction;
a rigidifying insert positioned in said elongated cutout and fixed to said gliding board blank preventing relative movement between said rigidifying insert and said gliding board;
said insert extending at least from an upper surface of the blank to at least lower surface of the blank.

23. A gliding board according to claim 1, wherein:
the gliding board is a snow ski.

24. A gliding board according to claim 22, wherein:
the gliding board is a snow ski.

25. A method of manufacturing a gliding board according to claim 9, wherein:
said making a gliding board blank consists of making a ski blank.

26. A gliding board according to claim 1, wherein:
said rigidifying element comprises a torsional rigidifying element, configured to increase torsional rigidity of said rear end of the gliding board relative to the gliding board without said rigidifying element.

27. A gliding board according to claim 22, wherein:

said rigidifying element comprises a torsional rigidifying element, configured to increase torsional rigidity of said rear end of said gliding board blank.

28. A method of manufacturing a gliding board according to claim 9, wherein:

said fixing said rigidifying insert to said gliding board blank, such that no relative movement is possible between said rigidifying insert and said gliding board blank comprises:

fixing said rigidifying insert to said gliding board blank to increase torsional rigidity of said rear end of said gliding board blank.

29. A gliding board comprising:

an upper sub-assembly;

a lower sub-assembly;

an intermediate core;

said upper sub-assembly including a first longitudinal opening;

said lower sub-assembly including a second longitudinal opening;

and said intermediate core including a third longitudinal opening;

each of said first, second, and third longitudinal openings being positioned at a rear end of said gliding board;

a rigidifying element positioned simultaneously in both of said second and third longitudinal openings;

a plurality of interchangeable rigidifying elements, said rigidifying element being one of said plurality of interchangeable rigidifying elements, for selective assembly as a component of the gliding board;

each of said plurality of interchangeable rigidifying elements providing the gliding board with at least one respectively different performance characteristic.

30. A gliding board according to claim 29, wherein:

said respectively different performance characteristic comprises a respectively different shape, whereby the gliding board is thereby configured for a respectively different activity.

31. A gliding board according to claim 30, wherein:

said respectively different performance characteristic comprises a respectively different material, whereby the gliding board is provided with a respectively different bending behavior.

32. A gliding board according to claim 1, further comprising:

means for removably affixing the rigidifying element in said second and third openings.

33. A gliding board according to claim 32, wherein:

said means comprises at least one screw.

34. A gliding board for practicing winter sports, said gliding board comprising:

a gliding board blank having a rear end with a rearwardly opened elongated cutout:

a rigidifying insert positioned in said elongated cutout and fixed to said gliding board blank preventing relative movement between said rigidifying insert and said gliding board;

a plurality of interchangeable rigidifying inserts, said rigidifying insert being one of said plurality of interchangeable rigidifying inserts, for selective assembly as a component of the gliding board;

each of said plurality of interchangeable rigidifying inserts providing the gliding board with at least one respectively different performance characteristic.

35. A gliding board according to claim 34, wherein:

said respectively different performance characteristic comprises a respectively different shape, whereby the gliding board is thereby configured for a respectively different activity.

36. A gliding board according to claim 35, wherein:

said respectively different performance characteristic comprises a respectively different material, whereby the gliding board is provided with a respectively different bending behavior.

37. A gliding board according to claim 22, further comprising:

means for removably affixing the rigidifying insert in said second and third openings.

38. A gliding board according to claim 37, wherein:

said means comprises at least one screw.

39. A method of manufacturing gliding board comprising:

making a gliding board blank having a rear end with an elongated cutout;

choosing one rigidifying insert from among a plurality interchangeable rigidifying inserts;

each of said plurality of interchangeable rigidifying inserts providing the gliding board with at least one respectively different performance characteristic;

inserting a rigidifying insert within said elongated cutout;

fixing said rigidifying insert to said gliding board blank, such that no relative movement is possible between said rigidifying insert and said gliding board blank.

40. A method of manufacturing a gliding board according to claim 39, wherein:

said respectively different performance characteristic comprises a respectively different shape, whereby the gliding board is thereby configured for a respectively different activity.

41. A method of manufacturing a gliding board according to claim 40, wherein:

said respectively different performance characteristic comprises a respectively different material, whereby the gliding board is provided with a respectively different bending behavior.

42. A method of manufacturing a gliding board according to claim 9, wherein:

said fixing said rigidifying insert to said gliding board blank comprises removably fixing the rigidifying insert to said gliding board blank.

43. A method of manufacturing a gliding board according to claim 9, wherein:

said fixing said rigidifying insert to said gliding board blank comprises removably fixing the rigidifying insert to said gliding board blank by means of at least one screw.

44. A gliding board according to claim 1, wherein:

the first, second, and third longitudinal openings at the rear end of the gliding board defines a swallow tail gliding board blank with two laterally spaced-apart rear tips;

the rigidifying element is positioned in the first, second, and third longitudinal openings and provides against relative movement between the spaced-apart rear tips and the rigidifying element.

45. A gliding board according to claim 1, wherein:

the rigidifying element has a rearwardly open opening, giving the gliding board a swallow tail shape.

46. A gliding board according to claim 22, wherein:

the rigidifying insert has a rearwardly open opening, giving the gliding board a swallow tail shape.

47. A method of manufacturing a gliding board according to claim 9, wherein:

the rigidifying insert has a rearwardly open opening, giving the gliding board a swallow tail shape.

48. A method of manufacturing a gliding board according to claim 10, wherein:

said positioning said finishing spacer comprises positioning said finishing spacer in said elongated cutout, formed by at least said second and third longitudinal openings being superimposed, for machining in said elongated cutout in said rear end of said blank;

said positioning the rigidifying element comprises positioning the rigidifying element in said elongated cutout; before said positioning the rigidifying element in said elongated cutout, the method further comprises removing the finishing spacer from said longitudinal cutout.

49. A gliding board according to claim 29, wherein:

each of said first, second, and third longitudinal openings has a width progressively increasing in a rearward direction.

50. A gliding board according to claim 34, wherein:

said rearwardly opened elongated cutout has a width progressively increasing in a rearward direction.

51. A method of manufacturing a gliding board according to claim 9, wherein:

said elongated cutout has a width progressively increasing in a rearward direction.

* * * * *